United States Patent [19]

Goscianski et al.

[11] Patent Number: 4,516,089

[45] Date of Patent: May 7, 1985

[54] SYSTEM FOR RECEIVING MICROWAVE SIGNALS HAVING ORTHOGONAL POLARIZATIONS

[75] Inventors: Michel Goscianski, Amfreville sur Iton; François de Ronde, Lesigny, both of France

[73] Assignee: U.S. Philips Corporation, New York, N.Y.

[21] Appl. No.: 358,754

[22] Filed: Mar. 16, 1982

[30] Foreign Application Priority Data

Mar. 18, 1981 [FR] France ..... 81 05406

[51] Int. Cl.[3] ..... H01P 1/161

[52] U.S. Cl. ..... 333/135; 333/21 R; 333/21 A; 333/137; 333/208; 343/772

[58] Field of Search ..... 333/21 A, 127, 125, 333/126, 135, 137, 238, 246, 205, 248; 343/756, 772, 909, 784

[56] References Cited

U.S. PATENT DOCUMENTS

| | | | |
|---|---|---|---|
| 2,651,759 | 9/1953 | Lamont | 333/137 |
| 3,182,272 | 5/1965 | Borghetti | 333/21 A |
| 3,518,579 | 6/1970 | Hoffman | 333/238 X |
| 3,543,276 | 11/1970 | Epis | 343/756 |
| 4,178,574 | 12/1979 | Edens et al. . | |
| 4,282,530 | 8/1981 | Semplak | 343/784 |
| 4,410,866 | 10/1983 | Bui-Hai | 333/135 |

*Primary Examiner*—Eugene R. LaRoche
*Assistant Examiner*—Benny T. Lee
*Attorney, Agent, or Firm*—Robert J. Kraus

[57] ABSTRACT

A system is disclosed for coupling orthogonal polarized microwave signals from a reflector to signal processing circuits. The system includes successively a horn, a bandpass filter, a polarizer, a mode separator, and a housing for containing the circuits. The system is constructed from two half-shells. The horn, bandpass filter and polarizer form a waveguide portion which is coupled to the circuits by the mode separator.

5 Claims, 4 Drawing Figures

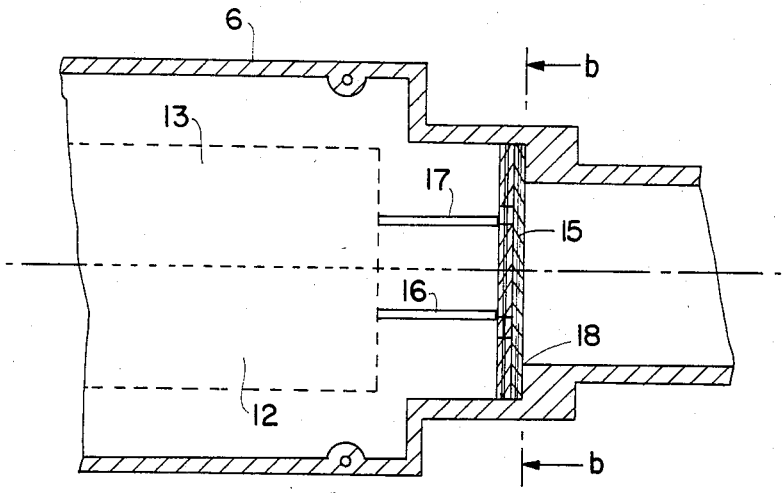
FIG. 2
FIG. 3
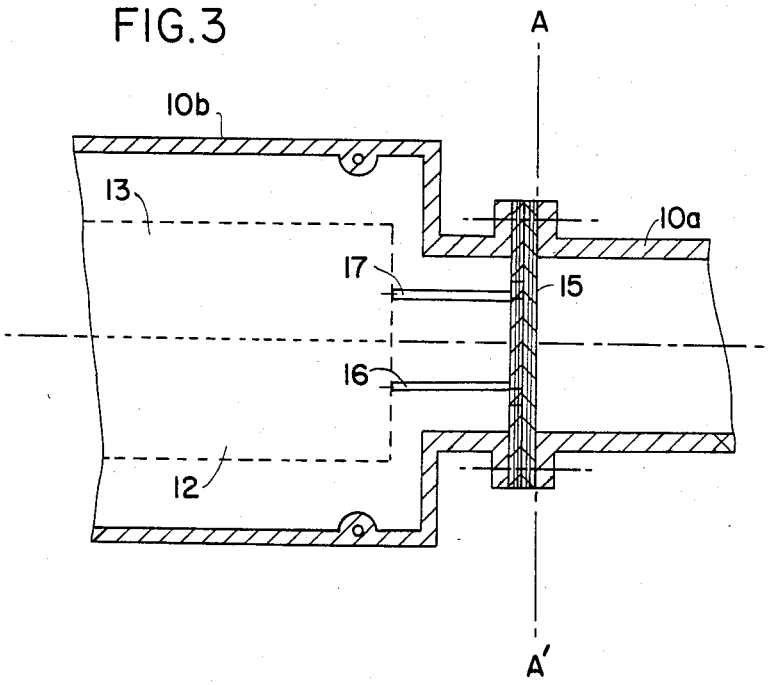

SYSTEM FOR RECEIVING MICROWAVE SIGNALS HAVING ORTHOGONAL POLARIZATIONS

BACKGROUND OF THE INVENTION

The present invention relates to a system for coupling microwave (sometimes called hyperfrequency) signals having orthogonal polarizations from a reflector to signal processing circuitry. Such a system typically comprises successively arranged elements including a bandpass filter, a polarizer, if necessary, a mode separator, and a housing containing signal processing circuitry such as amplifiers and frequency conversion circuits. This system can be used for the reception of orthogonally polarized television signals transmitted by geostationary satellites. Conventionally, these signals are transmitted in successive channels which partially overlap one another, in the frequency band of 11.7–12.5 gigahertz. It is possible to discriminate between overlapping channels by means of the different polarizations thereof.

The manufacture of conventional systems involves the precise assembly of the elements, which is an expensive operation. The present invention, however, proposes a system which is considerably simpler to manufacture and allows production on a larger scale.

SUMMARY OF THE INVENTION

In a system constructed in accordance with the invention, the horn and the bandpass filter are provided in the form of a waveguide which, along with the mode separator and the housing, is constructed from two half-shells which are symmetrical with respect to their longitudinal plane of assembly. These half-shells can be made by a common industrial process such as molding or injection of metal, or of plastic which is subsequently metal-plated. If the system is designed to receive signals with circular orthogonal polarizations it also comprises a polarizer which is included in the waveguide portion of the system. In either case the system is simple to manufacture and assemble.

In one embodiment of the invention the waveguide portion and the circuitry contained in the housing are coupled by a mode separator comprising a classic waveguide with rectangular cross section. The mode separator is subdivided into two distinct guides, if the system is to simultaneously receive two signals of different polarization. In another embodiment, the mode separator comprises at least one coaxial element projecting into the interior of the waveguide portion. In yet another embodiment, the mode separator comprises a printed circuit disposed transversely to the longitudinal axis of the waveguide portion.

BRIEF DESCRIPTION OF THE DRAWING

The invention will now be described with reference to the drawing in which:

FIGS. 2 and 3 are partial views of a second embodiment of the half-shells of the system according to the invention.

DESCRIPTION OF THE PREFERRED EMBODIMENTS

Figure 1A:
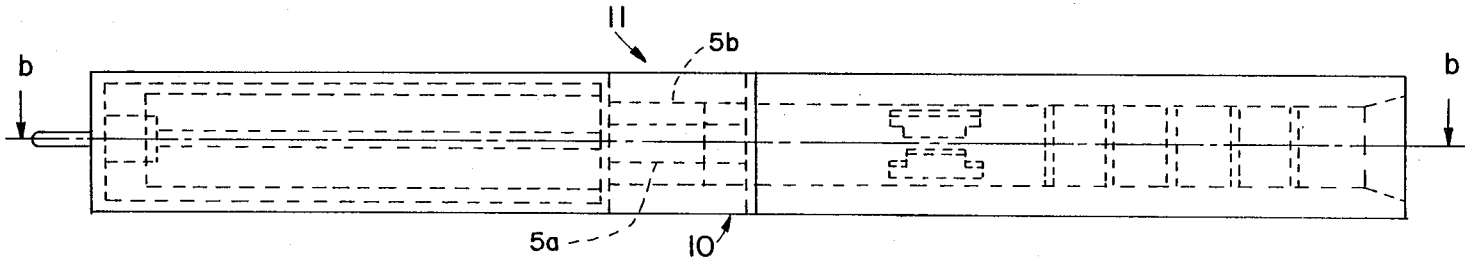
FIGS. 1*a* and 1*b* show a first embodiment of one of the half-shells of the system according to the invention.
Figure 1B:
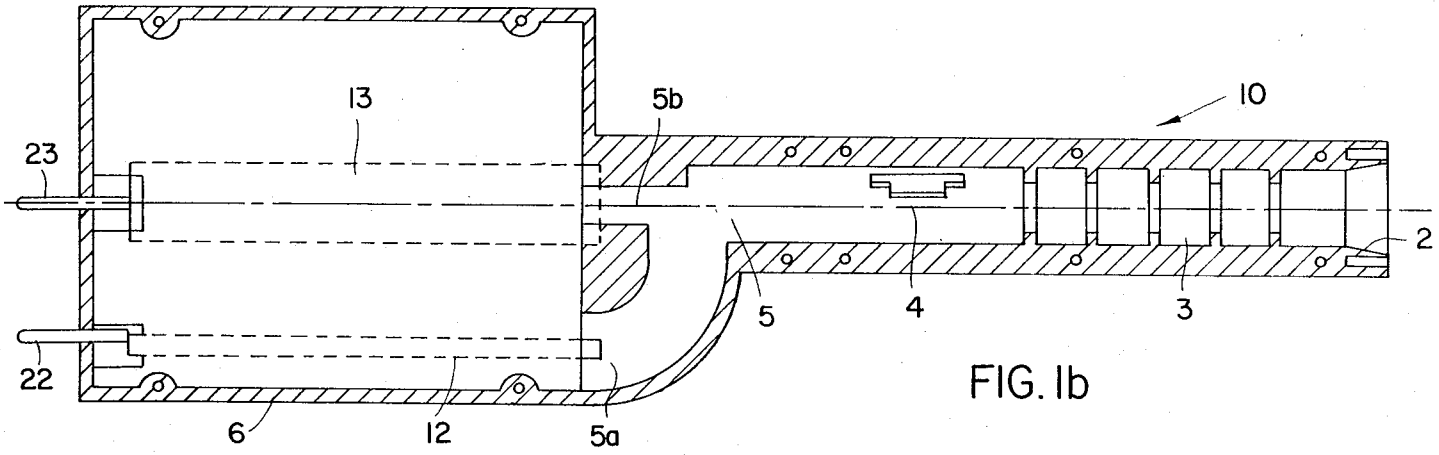

In the first embodiment, illustrated in FIGS. 1*a* and 1*b*, the system comprises a succession of elements arranged for coupling polarized microwave signals from a parabolic or other shape reflector (not shown) to signal processing circuitry (not shown). If the microwave signals are circularly-polarized, the successively-arranged elements include a receiving horn 2 held in the focus of the reflector, a bandpass filter 3, a polarizer 4 having a dielectric or metal blade, a mode separator 5 and a housing 6 containing electronic amplification and frequency conversion circuits which serve as an interface between the reception system and a television receiver. If the system is used for receiving microwave signals with linear orthogonal polarizations, polarizer 4 is not provided.

The elements 2 to 6 are constructed from two half-shells 10 and 11 which are symmetrical with respect to a longitudinal plane along which they can be assembled onto each other (with the aid, for example of attachment screws). These two half-shells 10 and 11 can be made by the use of a common industrial process, such as molding or injection of metal, or by injection of plastic that is subsequently metal-plated. In this example the half-shells are symmetrical but not identical and hence cannot be produced with the same mold.

Coupling between the waveguide portion (2–4) and the circuits contained in housing 6 is provided by subdivision of the mode separator 5 into two waveguides 5*a* and 5*b* having orthogonal rectangular cross sections. These two waveguides are coupled to two support plates 12 and 13, respectively, for the circuits. The plates are oriented perpendicularly with respect to one another in the housing. Each plate 12 or 13 bears the necessary circuits (typically printed circuit boards) for amplification and frequency conversion of the microwave signals of corresponding circular polarization (left or right). At the ends of these plates remote from the mode separator, cables 22 and 23 are provided for connecting the circuits to further signal processing circuitry and to a television receiver. Housing 6 provides means for mounting support plates 12 and 13 and also protects the circuits on the plates.

In another embodiment of the invention, illustrated with the aid of the partial views in FIGS. 2 and 3, coupling between the waveguide portion and the circuits contained in housing 6 is provided by a receiving element 15 shown in cross section (in plane bb of FIG. 2). The receiving element is in the form of a conventional printed circuit (such as a microstrip) comprising a plane structure on a dielectric support. This element 15 is coupled to the plates 12 and 13 by means of two coaxial lines 16 and 17, respectively, carrying the signals of left and right circular polarization. The cables 22 and 23 are provided at the other ends of the plates as illustrated in FIG. 1*i b*. In this example, the half shells are not only symmetrical but identical and can therefore be made with the same mold, which further reduces the costs of manufacture.

In FIG. 2 the element 15 is placed against a shoulder 18 situated inside the half-shells 10 and 11. FIG. 3 illustrates a similar embodiment where the half-shells 10 and 11 comprise parts 10*a*, 10*b* and 11*a*, 11*b*, respectively which sandwich the element 15 along plane AA.

The present invention is not limited to the above-described embodiments, but includes all embodiments and variations thereof falling within the scope of the appended claims. For example, in the embodiment illustrated in FIGS. 1*a* and 1*b*, for reception of just one orthogonal signal the mode separator 5 can be provided in the form of a single waveguide of rectangular cross section coupled to a single support plate for the circuitry in housing 6. Alternatively, coupling between the waveguide portion and this circuitry can be provided by one coaxial element (for reception of just one signal), or by two coaxial elements (for simultaneous reception of two signals of different polarization) projecting into the waveguide portion to an extent sufficient to pick up the signals. The coaxial element or elements thus provided are connected at their other ends to the circuitry in housing 6.

In the case where the mode separator is provided in the form of a waveguide (subdivided or not), the bandpass filter, instead of being provided after the receiving horn, can be placed between the waveguide or waveguides of the mode separator and the corresponding support plate or plates of the circuitry in housing 6.

Although the system is described for use at a specific frequency range, it is not limited to this range and can be used at any frequency compatible with waveguide devices.

Also, the two half-shells 10 and 11 are preferably provided with means for attachment to arms of the reflector, and with a radome placed on the receiving horn 2 to complete weatherproofing of the system.

What is claimed is:

1. A system for coupling at least one of two orthogonally-polarized microwave signals from a reflector to at least one respective signal processing circuit, said system including a structure comprising two half-shells which are symmetrical with respect to a longitudinal plane of assembly, said structure including, in succession, a waveguide portion, a mode separator and a housing containing at least one respective support plate for said at least one signal processing circuit, said waveguide portion forming a horn and a bandpass filter, and said mode separator comprising means for coupling at least one of said signals from the waveguide portion to the at least one respective support plate in the housing.

2. A system as in claim 1 wherein said mode separator comprises at least one waveguide having a rectangular cross-section.

3. A system as in claim 2 where said housing contains first and second orthogonally-oriented support plates, and where said mode separator comprises first and second orthogonally oriented, rectangular cross-section waveguides for coupling said orthogonally-polarized microwave signals to said first and second support plates, respectively.

4. A system as in claim 1 wherein said mode separator comprises a planar printed circuit disposed within said structure between said waveguide portion and said housing, said planar printed circuit extending transversely to the longitudinal plane of assembly.

5. A system as in claim 1, 2, 3 or 4 where said bandpass filter is situated between the horn and the mode separator.

* * * * *